US006943744B1

(12) United States Patent
Vezmar

(10) Patent No.: US 6,943,744 B1
(45) Date of Patent: Sep. 13, 2005

(54) WAVEGUIDE DIPLEXING AND FILTERING DEVICE

(75) Inventor: John Michael Vezmar, Marshall, MI (US)

(73) Assignee: Patriot Antenna Systems, Inc., Albion, MI (US)

( * ) Notice: Subject to any disclaimer, the term of this patent is extended or adjusted under 35 U.S.C. 154(b) by 153 days.

(21) Appl. No.: 10/616,017

(22) Filed: Jul. 9, 2003

(51) Int. Cl.[7] ..... H01Q 13/00; H01P 5/12

(52) U.S. Cl. ..... 343/756; 343/786; 333/126; 333/137

(58) Field of Search ..... 343/756, 786; 333/21 A, 126, 135, 137

(56) References Cited

U.S. PATENT DOCUMENTS

| | | | | |
|---|---|---|---|---|
| 2,432,093 | A | 12/1947 | Fox | |
| 4,060,779 | A | 11/1977 | Atia et al. | |
| 4,410,866 | A | 10/1983 | Bui-Hai | |
| 4,780,694 | A | 10/1988 | Kich et al. | |
| 4,912,436 | A | 3/1990 | Alford et al. | |
| 4,920,351 | A * | 4/1990 | Bartlett et al. | 343/756 |
| 4,970,480 | A | 11/1990 | Wong et al. | |
| 5,162,808 | A | 11/1992 | Kim | |
| 5,266,911 | A | 11/1993 | Perpall et al. | |
| 5,907,309 | A | 5/1999 | Anderson et al. | |
| 6,046,702 | A | 4/2000 | Curtis et al. | |
| 6,166,699 | A | 12/2000 | Khammouni et al. | |

* cited by examiner

*Primary Examiner*—Michael C. Wimer
(74) *Attorney, Agent, or Firm*—Young & Basile, P.C.

(57) ABSTRACT

A waveguide diplexing and filtering device for separating two polarities of one frequency band and at least one polarity of another frequency band of an electromagnetic or microwave signal. The waveguide diplexing and filtering device of the present invention provides an enclosure having a longitudinal axis with a common channel formed in the enclosure and terminating at a common port. The common channel and the common port are adapted to receive the electromagnetic or microwave signal. A side channel is formed in the enclosure and terminates at a side port. The side channel is in communication with a common channel, and the side channel is adapted to cut off the lower frequency of the microwave signal and allow the upper frequency of the microwave signal to propagate through the side channel to the side port. The main channel is formed in the enclosure and terminates at a main port and is in communication with the common channel. At least one waveguide iris element is mounted within the main channel and is adapted to filter the upper frequency of the microwave signal and allow the two polarities of the lower frequency of the microwave signal to pass through the iris element and propagate along the main channel to the main port.

28 Claims, 2 Drawing Sheets

WAVEGUIDE DIPLEXING AND FILTERING DEVICE

FIELD OF THE INVENTION

The present invention relates to a waveguide diplexing and filtering device, and in particular, a waveguide device that provides diplexing and filtering of an electromagnetic or microwave signal such that two polarities of one frequency band and at least one polarity of another frequency band are separated.

BACKGROUND OF THE INVENTION

It is well known that various communication systems employ more than one frequency band when transmitting electromagnetic or microwave signals from a transmitting station to a receiving station. A typical example of such a communication system is a satellite communication system wherein various bands of signals are transmitted between a satellite above the earth (geosynchronous orbit) and ground stations on the earth. Two such frequency bands of interest herein include the Ka band of 20 GHZ, which ranges from 19.7 to 20.2 GHZ, and the Ku band of 12 GHZ, which ranges between 11.7 to 12.7 GHZ.

Historically, the practice has been to provide separate antennas for transmission or reception of each of the bands because there is insufficient band width on any one of the antenna systems or terminals to transmit more than one of the bands. In some cases, where bands are close together and, collectively, do not occupy an excess amount of spectral space, it has been possible to share a plurality of bands on one antenna. However, separate antennas have been employed for different portions of the spectrum.

Microwave multiplexers have been developed and utilized in communication systems, such as satellite communication systems, for combining numerous signal channels for transmission along a common transmission path, such as an antenna feed. In a frequently employed form of satellite communication system, an antenna carried by a satellite transmits and/or receives electromagnetic signals propagating between a satellite and an antenna located on the earth's surface. Plural signal channels separated by frequency and/or by polarization are communicated by the two antennas. It is important that the signals of all the channels, whether they are literally polarized or circularly polarized, propagate along the same path in a common direction so that all of the signals transmitted by a transmitting antenna reach a receiving antenna.

While such multiplexers have been employed in both land-based and in satellite communication systems, problems arise in that multiplexers are typically complex and heavy in their mechanical structure. Such multiplexers are typically designed for low-volume, high-performance systems, but the manufacturing costs are prohibitive for high-volume, low-cost components. Therefore, it would be desirable to provide a simple, lightweight, and inexpensive diplexer that could accommodate various frequencies and polarities.

SUMMARY OF THE INVENTION

The present invention provides a waveguide diplexing and filtering device for separating two polarities of one frequency band and at least one polarity of another frequency band of an electromagnetic or microwave signal. The present invention provides an enclosure having a longitudinal axis wherein a common channel is formed in the enclosure and terminates at a common port. The common channel and common port are adapted to receive a microwave signal having at least two substantially different frequencies including an upper frequency and a lower frequency, wherein the lower frequency signal includes two polarities. A side channel is formed in the enclosure and terminates at a side port. The side channel is in communication with the common channel and is adapted to cut off the lower frequency of the microwave signal and allow the upper frequency of the microwave signal to propagate through the side channel to the side port. A main channel is formed in the enclosure and terminates at a main port. The main channel is in communication with the common channel. At least one waveguide iris element is mounted within the main channel and is adapted to filter the upper frequency of the microwave signal and allow two polarities of the lower frequency of the microwave signal to pass through the iris element and propagate along the main channel to the main port. A feed horn may be coupled to the common port and adapted to direct the microwave signal into the common port. The side port and the main port are communicable with a low noise block (LNB) converter to amplify and reduce the frequencies to a lower frequency.

BRIEF DESCRIPTION OF THE DRAWINGS

The description herein makes reference to the accompanying drawings wherein like reference numerals refer to like parts throughout several views and wherein.

DESCRIPTION OF THE PREFERRED EMBODIMENT

Figure 1:
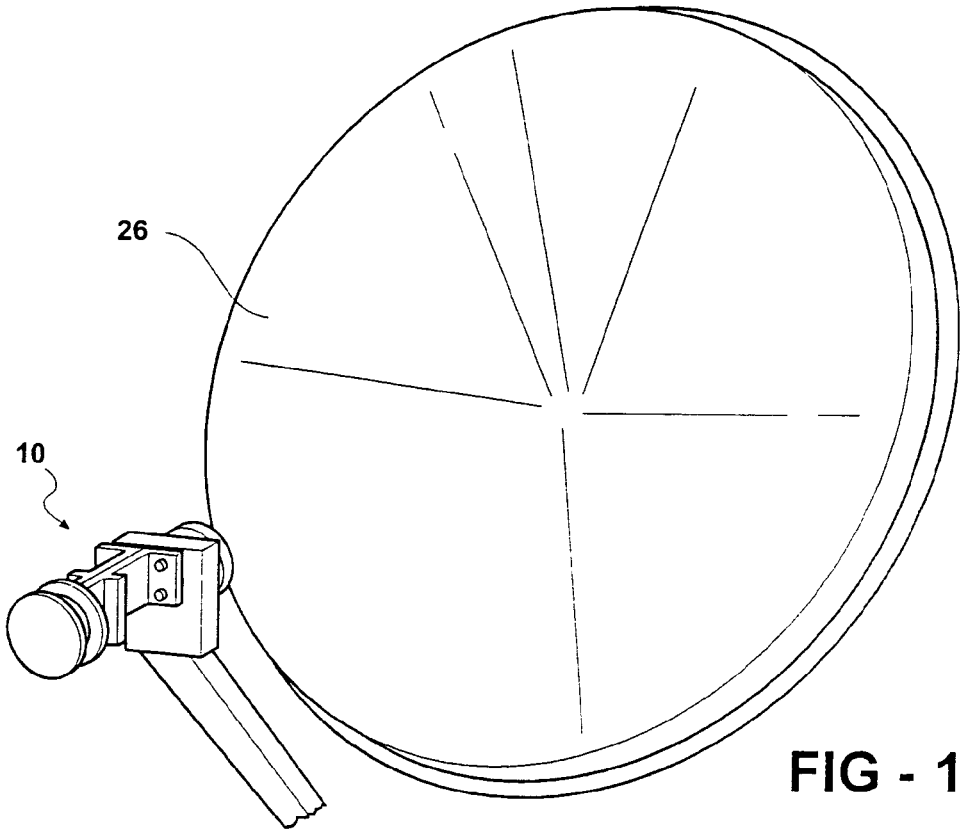
FIG. 1 is a perspective view of the waveguide diplexing and filtering device of the present invention.

Referring to the drawings, the present invention will now be described in detail with reference to the disclosed embodiment.

Figure 2:
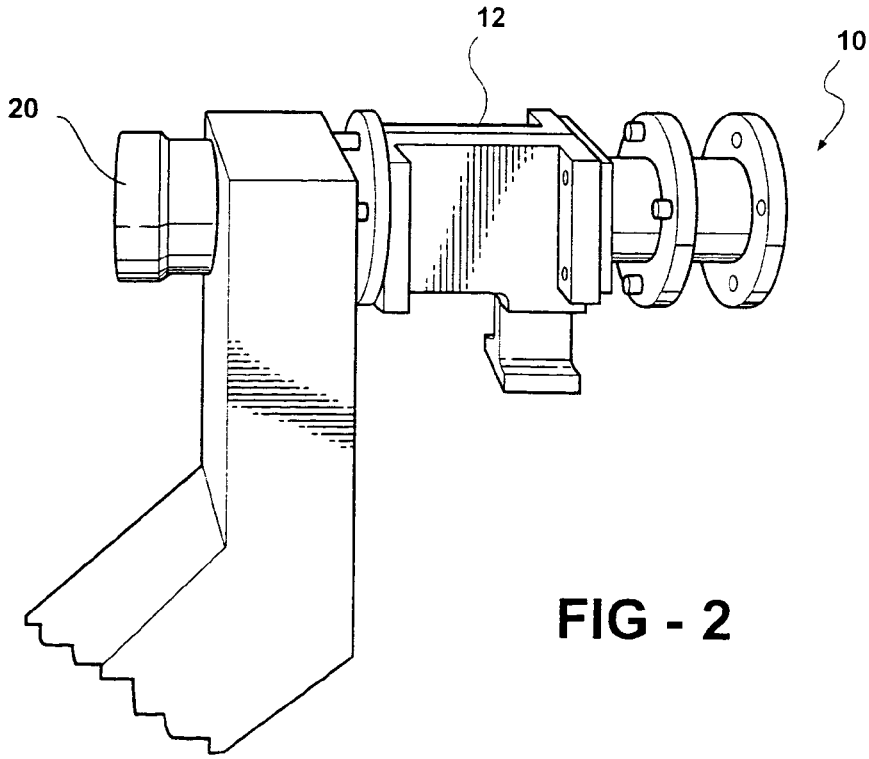
FIG. 2 is a perspective view showing the waveguide diplexing and filtering device of the present invention mounted to an antenna dish.
Figure 3:
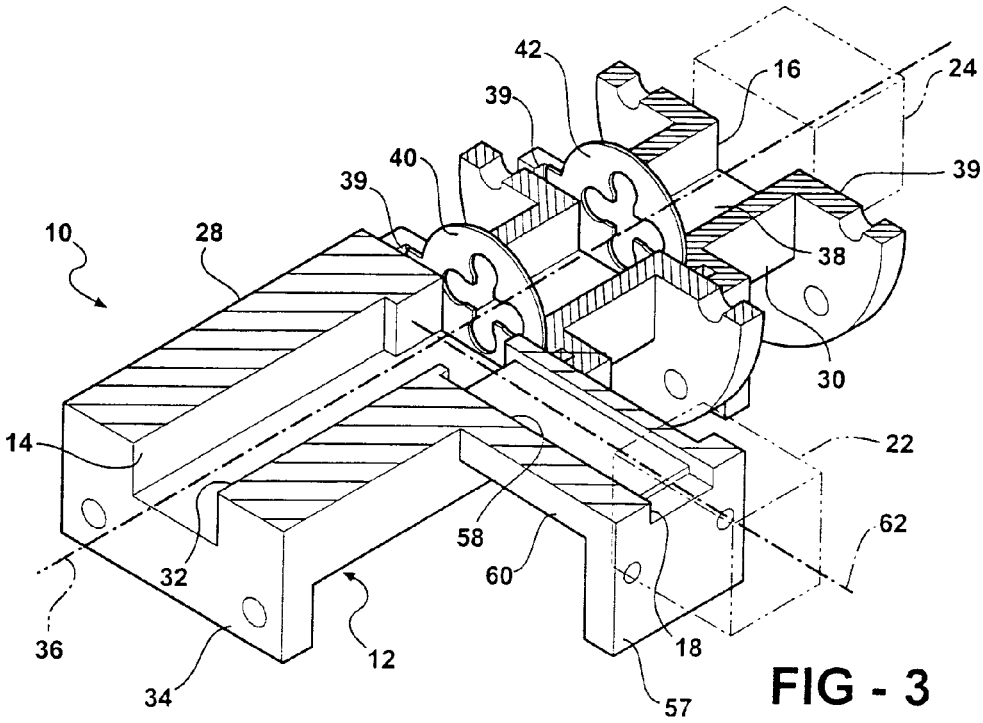
FIG. 3 is a perspective cross-sectional view of the waveguide diplexing and filtering device of the present invention.

FIGS. 1–3 illustrate a waveguide diplexing and filtering device 10 of the present invention for separating two polarities of one frequency band and at least one polarity of another frequency band of an electromagnetic or microwave signal. The waveguide device 10 provides an enclosure 12 having a common port 14, a main port 16, and a side port 18. A feed horn 20 may be coupled to the common port 14 of the enclosure 12 to direct and guide the electromagnetic or microwave signal into the common port 14. Low noise block (LNB) converters 22, 24 are connected to the main port 16 and the side port 18, respectively, of the enclosure 12. The LNB's 16, 18 amplify and convert the separated frequency bands into a lower frequency that may be utilized by a receiver. The waveguide device 10 may be mounted to an antenna dish 26 for receiving and/or transmitting the electromagnetic or microwave signal. Although the drawings depict only one waveguide device 10 being utilized, the present invention also anticipates the use of more than one waveguide device 10 to provide further multiplexing or diplexing of the electromagnetic or microwave signal.

The present invention is ideally suited for receiving an electromagnetic or microwave signal having a Ku band signal with two polarities and a Ka band signal with a single polarity. The Ku band has a substantially 12 GHz signal ranging from 10.7 to 12.75 GHz. The Ka band is a higher frequency having a substantially 20 GHz signal ranging from 19.7 to 20.2 GHz. The polarities of the Ka band frequency are linear thereby providing a horizontal and a vertical polarity signal. Although the embodiment described in the specification is designed to accommodate an electromagnetic or microwave signal having a Ku band signal with two polarities and a Ka band with a single polarity, certain dimensional changes may be made to the waveguide device 10 to allow for the accommodation of an electromagnetic or microwave signal having different frequency bands and polarities. The polarities may also be converted prior to being separated and filtered by the waveguide device. For instance, a polarizer (not shown) may be utilized to convert a circular polarity signal into a linear polarity signal prior to the microwave signal being separated and filtered by the waveguide device 10.

Figure 5:
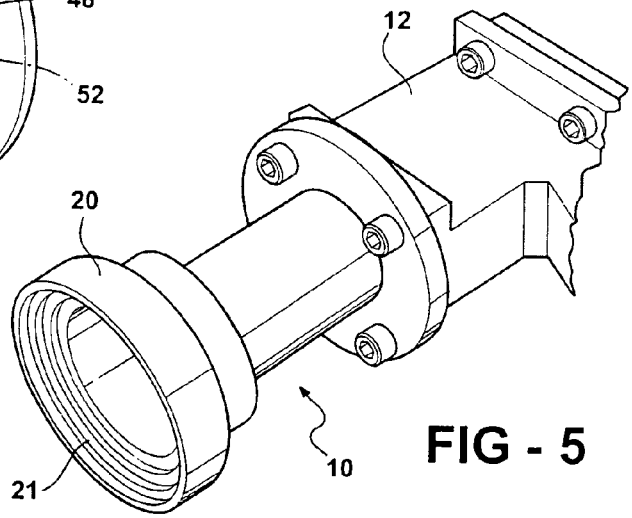
FIG. 5 is a perspective view of a feed horn of the waveguide diplexing and filtering device of the present invention.

In order to gather and direct the proper microwave signal into the waveguide device 10, the feed horn 20 provides a substantially cylindrical structure having concentric rings 21 which decrease in diameter as they approach the common port 14, as seen in FIG. 5. The feed horn 20 is fabricated from a conductive material, such as cast zinc or aluminum, which allows the microwave signal to propagate through the feed horn 20. The feed horn 20 is designed to receive the microwave signal at the focal point of the antenna dish 26 and is designed to accept satellite signals while rejecting unwanted signals, such as those bounced from nearby walls or from nearby telephone and/or television towers that might not have an antenna dish. The concentric or scalar rings 21 of the feed horn 20 are designed to accept desired signals and assist in rejecting undesired frequencies. The feed horn 20 is connected to and communicates with the common port 14 to direct the microwave signal into the enclosure 12 of the waveguide device 10.

To separate and filter the microwave signal, the enclosure 12 of the waveguide device 10 is fabricated from a conductive material, such as cast zinc or aluminum, having a substantially rectangular portion 28 and a substantially cylindrical portion 30, as seen in FIGS. 1–3. The rectangular portion 28 has a common channel 32 that terminates at the common port 14. The common port 14 opens to an end wall 34 provided on the rectangular portion 28 of the enclosure 12. The common channel 32 extends along a longitudinal axis 36 that is common to and coaxial with a longitudinal axis 36 of the enclosure 12. The common channel 32 and the common port 14 have a substantially square cross-section having sides that are 0.574 inches in length. The size of the common channel 32 determines which frequencies of the signal are cut off by the waveguide device 10.

Figure 4:
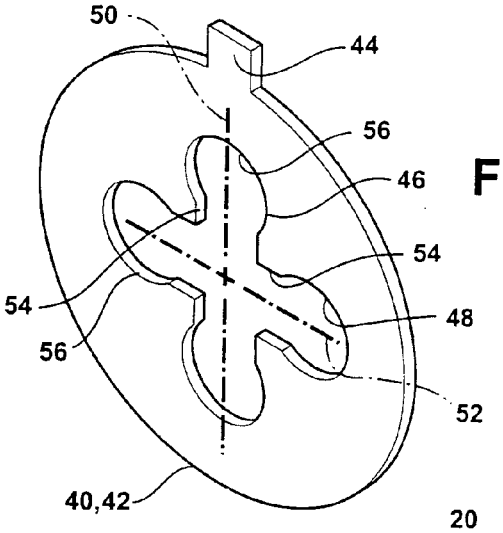
FIG. 4 is a perspective view of a waveguide iris element of the waveguide diplexing and filtering device of the present invention.

To filter the microwave signal, the common channel 32 communicates and is continuous with a main channel 38 which terminates at the main port 16. The main port 16 opens into an end wall 39 of the cylindrical portion 30 of the enclosure 12. The main channel 38 has a longitudinal axis 36 that is coaxial with the longitudinal axis 36 of the enclosure 12 and the common channel 32. The main channel 38 also has a substantially square cross-section having the same dimensions as the common channel 32. Again, the size of the main channel 38 determines which frequencies are cut off by the waveguide device 10. The main channel 38 is disposed within the cylindrical portion 30 of the enclosure 12. Two slots 39 are provided within the main channel 38 for capturing two waveguide iris elements 40, 42. The waveguide iris elements 40, 42 are fabricated from a thin, substantially circular conductive material that spans across the main channel 38. As seen in FIGS. 3 and 4, each waveguide iris element 40, 42 is 0.025 inches thick and provides a substantially rectangular locating tab 44 which complementarily engages the slot 39 in the main channel 38 to radially locate the waveguide iris elements 40, 42 in their proper position. The spacing between the waveguide iris elements 40, 42 is a function of the wave length of the frequency band of the microwave signal. However, the relationship is complex and was partially determined by experiment. Thus, spacing of the waveguide iris elements 40, 42 in the present invention is 0.985 inches.

In order to filter the lower frequency Ku band signal from the higher frequency Ka band signal, each waveguide iris element 40, 42 has a substantially vertical slot 46 and a substantially horizontal slot 48 extending therethrough. The vertical slot 46 and the horizontal slot 48 have longitudinal axes 50, 52, respectively, that are substantially perpendicular to one another. Each slot 46, 48 has a substantially rectangular mid portion 54 and a pair of substantially arcuate end portions 56 that are integral with the rectangular mid portion 54. The size of the slots 46, 48 are designed to allow the lower frequency Ku band signal to pass and propagate through the slots 46, 48 while the upper frequency Ka band signal is prevented from passing through the waveguide iris elements 40, 42. To accomplish this, each rectangular mid portion 54 of the slots 46, 48 has a width of 0.150 inches. The length of the rectangular mid portions 54 are determined by the center line distances of the arcuate end portions 56. The distance between the center line axes of the arcuate end portions 56 is 0.382 inches. The radius of each arcuate end portions 56 is 0.096 inches. The vertical slot 46 allows for the passage of the vertical polarity of the Ku band signal, and the horizontal slot 48 allows for the passage of the horizontal polarity of the Ku band signal. The use of the two waveguide iris elements 40, 42 enhances the filtering of the Ku band signal. It should be noted that the present invention anticipates using additional waveguide iris elements to further enhance the filtering. Additional main channels could also be implemented with waveguide iris elements to provide filtering of additional frequency bands of the microwave signal.

To separate the higher frequency Ka band signal from the lower frequency Ku band signal, the side port 18, which terminates in an end wall 57 of the rectangular portion 28 of the enclosure 12, is in communication with a side channel 58. The side channel 58 is housed in a side arm portion 60 of the rectangular portion 28 of the enclosure 12. The side channel 58 has a longitudinal axis 62 that is substantially perpendicular to the longitudinal axis 36 of the enclosure 12, the common channel 32, and the main channel 38. However, the present invention anticipates that the side channel 58 could extend at various angles to the longitudinal axis 36 of the enclosure 12. The side channel 58 has a substantially rectangular cross-section and utilizes a waveguide cutoff theory to propagate only the higher frequency Ka band along the side channel 58. The waveguide cutoff is based on the formula:

$$f_c = c/2a$$

where $f_c$ is the frequency below which all signals are cut off, c is the speed of light, and a equals the dimension of the waveguide perpendicular to the polarity of the signal. The width of the side channel 58 is 0.420 inches and the height of the side channel 58 is 0.060 inches. As noted in the above formula, the size of the width of the side channel 58 determines the frequency cut off. However, the height of the side channel 58 is immaterial since the higher frequency Ka band has a single polarity substantially perpendicular to the width of the side channel 58. The side channel 58 extends in the H (magnetic) plane, but the side channel 58 could be oriented in the E (electrical) plane. Although the side channel 58 is substantially rectangular, the side channel 58 could be substantially square, round or otherwise to support two polarities instead of one.

In operation, the waveguide device 10 is mounted to the antenna dish or satellite antenna 26. The waveguide device 10 is spaced so that the focal point of the microwave signal received by the antenna dish 26 is located at the feed horn 20 of the waveguide device 10. The electromagnetic or microwave signal propagates into the common port 14 and along the common channel 32. The electromagnetic or microwave signal is filtered by the waveguide iris elements 40, 42 which allow the lower frequency Ku band to pass through the waveguide iris elements 40, 42 and propagate along the main channel 38 where the LNB 22 amplifies and converts the Ku band signal to a lower frequency. The higher frequency Ku band propagates along the side channel 58 where it is received by the LNB 24. The LNB 24 amplifies and converts the Ka band signal to a lower frequency.

While the description has been described in connection with what is presently considered to be the most practical and preferred embodiment, it should be understood that the invention is not to be limited to those disclosed in the embodiment, but to the contrary, it is intended to cover various modifications and equivalent arrangements included within the spirit and scope of the appended claims which scope is intended to be accorded the broadest interpretation so as to encompass all such modifications and equivalent structures as is permitted under the law.

What is claimed is:

1. A waveguide diplexing and filtering device, comprising:

an enclosure having a longitudinal axis;

a common channel formed in said enclosure and terminating at a common port, and said common channel and said common port adapted to receive a microwave signal having at least two substantially different frequencies including an upper frequency and a lower frequency wherein said lower frequency includes two polarities;

a side channel formed in said enclosure and terminating at a side port, and said side channel in communication with said common channel, and said side channel adapted to cut off said lower frequency of said microwave signal and allow said upper frequency of said microwave signal to propagate through said side channel to said side port;

a main channel formed in said enclosure, terminating at a main port, and communicating with said common channel; and at least one waveguide iris element mounted within said main channel and adapted to filter said upper frequency of said microwave signal and allow said two polarities of said lower frequency of said microwave signal to pass through said iris element and propagate along said main channel to said main port.

2. The waveguide diplexing and filtering device stated in claim 1, further comprising:

a feed horn coupled to said common port and adapted to direct said microwave signal into said common port.

3. The waveguide diplexing and filtering device stated in claim 1, further comprising:

said lower frequency of said microwave signal having a substantially 12 GHZ signal ranging from 10.7 to 12.75 GHZ.

4. The waveguide diplexing and filtering device stated in claim 1, further comprising:

said upper frequency of said microwave signal having a substantially 20 GHZ signal ranging from 19.7 to 20.2 GHZ.

5. The waveguide diplexing and filtering device stated in claim 1, further comprising:

said main channel having a substantially square cross section.

6. The waveguide diplexing and filtering device stated in claim 1, further comprising:

said common channel and said main channel having a longitudinal axis coaxial with said longitudinal axis of said enclosure; and said side channel having a longitudinal axis extending at an angle relative to said longitudinal axis of said enclosure.

7. The waveguide diplexing and filtering device stated in claim 1, further comprising:

said waveguide iris element having a substantially horizontal slot and a substantially vertical slot substantially perpendicular to one another.

8. The waveguide diplexing and filtering device stated in claim 1, further comprising:

said side port and said main port communicatable with a low noise block (LNB) converter.

9. A waveguide diplexing and filtering device, comprising:

an enclosure having a longitudinal axis;

a common channel formed within said enclosure and terminating at a common port, and said common channel having a longitudinal axis coaxially aligned with said longitudinal axis of said enclosure, and said common port adapted to receive a microwave signal having a lower frequency and an upper frequency wherein said lower frequency has two polarities;

a side channel formed within said enclosure and terminating at a side port, and said side channel having a longitudinal axis that extends at an angle with respect to said longitudinal axis of said enclosure;

said side channel in communication with said common channel and adapted to cut off said lower frequency of said microwave signal and allow said upper frequency of said microwave signal to propagate along said side channel to said side port;

a main channel formed in said enclosure and terminating at a main port, and said main channel having a longitudinal axis coaxial with said longitudinal axis of said enclosure, and said main channel in communication with said common channel; and at least one waveguide iris element mounted within said main channel, and said at least one iris element having a pair of slots extending therethrough wherein said slots are substantially perpendicular to one another and adapted to filter said upper frequency of said microwave signal and allow said two polarities of said lower frequency to pass through said at least one waveguide iris element and propagate along said main channel to said main port.

10. The waveguide diplexing and filtering device stated in claim 9, further comprising:

a feed horn coupled to said common port and adapted to direct said microwave signal into said common port, and said feed horn having a longitudinal axis coaxially aligned with said longitudinal axis of said enclosure.

11. The waveguide diplexing and filtering device stated in claim 9, further comprising:

said lower frequency of said microwave signal having a substantially 12 GHZ signal ranging from 10.7 to 12.75 GHZ.

12. The waveguide filtering device stated in claim 9, further comprising:

said upper frequency of said microwave signal having a substantially 20 GHZ signal ranging from 19.7 to 20.2 GHZ.

13. The waveguide filtering device stated in claim 9, further comprising:

said two polarities of said lower frequency of said microwave signal having linear polarities wherein said polarities are vertical and horizontal.

14. The waveguide diplexing and filtering device stated in claim 9, further comprising:

said side channel lying in the H (magnetic) plane.

15. The waveguide diplexing and filtering device stated in claim 9, further comprising:

said side channel lying in the E (electrical) plane.

16. The waveguide diplexing and filtering device stated in claim 9, further comprising:

said side channel having a substantially rectangular cross section for receiving a single polarity of said upper frequency of said microwave signal.

17. The waveguide diplexing and filtering device stated in claim 9, further comprising:

said side channel having a substantially square cross section adapted to receive two polarities of said upper frequency of said microwave signal.

18. The waveguide diplexing and filtering device stated in claim 9, further comprising:

said side channel having a substantially circular cross section adapted to receive two polarities of said upper frequency of said microwave signal.

19. The waveguide diplexing and filtering device stated in claim 9, further comprising:

said main channel having a substantially square cross section.

20. The waveguide diplexing and filtering device stated in claim 9, further comprising:

said common channel and said main channel having a longitudinal axis coaxial with said longitudinal axis of said enclosure; and said side channel having a longitudinal axis extending at an angle relative to said longitudinal axis of said enclosure.

21. The waveguide diplexing and filtering device stated in claim 20, further comprising:

said angle between said longitudinal axis of said side channel and said longitudinal axis of said enclosure being substantially 90 degrees.

22. The waveguide diplexing and filtering device stated in claim 9, further comprising:

said waveguide iris element having a substantially horizontal slot and a substantially vertical slot extending therethrough, and said horizontal slot and said vertical slot being substantially perpendicular to one another.

23. The waveguide diplexing and filtering device stated in claim 22, further comprising:

said horizontal slot and said vertical slot of said waveguide iris element each having a rectangular mid-portion and two arcuate end portions.

24. The waveguide diplexing and filtering device stated in claim 9, further comprising:

said side port and said main port each communicatable with a low noise block (LNB) converter for converting said upper and lower frequency of said microwave signal to a lower frequency.

25. A method for waveguide diplexing and filtering, comprising the steps of:

providing an enclosure having a common channel terminating at a common port;

receiving a microwave signal in said common port and said common channel wherein said microwave signal has at least two substantially different frequencies comprising an upper frequency and a lower frequency wherein at least said lower frequency has two polarities;

filtering said microwave signal through at least one waveguide iris element mounted within a main channel of said enclosure wherein said main channel is in communication with said common channel, and said waveguide iris element having a pair of slots extending therethrough and substantially perpendicular to one another, and said slots dimensionally designed to allow both polarities of said lower frequency of said microwave signal to propagate through said waveguide iris element along said main channel to a main port wherein said main channel terminates; and diplexing said microwave signal through a side channel formed in said enclosure wherein said side channel communicates with said common channel and wherein said side channel is dimensionally designed to create a waveguide cutoff by allowing said upper frequency of said microwave signal to propagate through and along said side channel to a side port where said side channel terminates.

26. The method stated in claim 25, further comprising the steps of:

collecting and directing said microwave signal through a feed horn and into said common port.

27. The method stated in claim 25, further comprising the steps of:

providing said microwave signal with said lower frequency of substantially 12 GHZ and said upper frequency of substantially 20 GHZ.

28. The method stated in claim 25, further comprising:

converting said upper and lower frequency microwave signals from said side port and said main port into lower frequency microwave signals.

* * * * *

UNITED STATES PATENT AND TRADEMARK OFFICE

CERTIFICATE OF CORRECTION

PATENT NO. : 6,943,744 B1
DATED : September 13, 2005
INVENTOR(S) : Vezmar

It is certified that error appears in the above-identified patent and that said Letters Patent is hereby corrected as shown below:

Drawings,
Sheet 2, FIG. 3, the reference numeral “39” should read -- 37 --.

Column 3,
Line 62, delete “39” and insert -- 37 --.

Signed and Sealed this

Twentieth Day of December, 2005

JON W. DUDAS
*Director of the United States Patent and Trademark Office*